US007156084B1

(12) United States Patent
Landis

(10) Patent No.: US 7,156,084 B1
(45) Date of Patent: Jan. 2, 2007

(54) PAINT-BALL SPORT GUN WITH ADJUSTABLE DETENT ASSEMBLY

(75) Inventor: John D. Landis, Port Hueneme, CA (US)

(73) Assignee: JDL Engineering, LLC, Oxnard, CA (US)

( * ) Notice: Subject to any disclaimer, the term of this patent is extended or adjusted under 35 U.S.C. 154(b) by 237 days.

(21) Appl. No.: 10/881,233

(22) Filed: Jun. 30, 2004

Related U.S. Application Data

(60) Provisional application No. 60/484,110, filed on Jun. 30, 2003.

(51) Int. Cl.
*F41A 9/61* (2006.01)

(52) U.S. Cl. ..... 124/50

(58) Field of Classification Search ..... 124/49, 124/50; 292/251
See application file for complete search history.

(56) References Cited

U.S. PATENT DOCUMENTS

| | | | | | |
|---|---|---|---|---|---|
| 2,345,127 | A * | 3/1944 | Kehne | 42/75.02 |
| 2,382,676 | A * | 8/1945 | Swartz | 42/62 |
| 3,171,182 | A * | 3/1965 | Danehy | 411/552 |
| 3,250,559 | A * | 5/1966 | Sommerfeld | 292/251 |
| 3,897,075 | A * | 7/1975 | Cutter | 280/626 |
| 4,320,844 | A * | 3/1982 | Cooper | 215/260 |
| 4,848,388 | A * | 7/1989 | Waldbusser | 137/80 |
| 4,934,081 | A * | 6/1990 | Mooney | 42/62 |
| 5,165,204 | A * | 11/1992 | Luedeke et al. | 451/342 |
| D357,176 | S * | 4/1995 | Ernest et al. | D8/387 |
| 5,630,406 | A * | 5/1997 | Dumont | 124/56 |
| 6,007,341 | A * | 12/1999 | Koch | 434/252 |
| 6,468,012 | B1 * | 10/2002 | Ellis et al. | 411/353 |
| 6,701,907 | B1 * | 3/2004 | Christopher et al. | 124/48 |
| 6,739,322 | B1 * | 5/2004 | Rice et al. | 124/49 |
| 6,761,521 | B1 * | 7/2004 | McCormack et al. | 411/353 |
| 6,880,281 | B1 * | 4/2005 | Orr | 42/70.01 |
| 2003/0154812 | A1 * | 8/2003 | Girlando et al. | 74/473.28 |
| 2004/0112163 | A1 * | 6/2004 | Girlando et al. | 74/473.28 |
| 2005/0115550 | A1 * | 6/2005 | Jones | 124/65 |

* cited by examiner

*Primary Examiner*—Michael J Carone
*Assistant Examiner*—John A Radi
(74) *Attorney, Agent, or Firm*—Kenneth J. Hovet; Patrick F. Bright

(57) ABSTRACT

A detent body with a center bore is secured to the chamber wall of a paint-ball gun. A floating detent with a hollow core and a domed tip reciprocates within the center bore, allowing the tip to extend into the chamber to restrict movement of a paint ball. Axially aligned slots extend through opposing sides of the floating detent. A pin extends through the slots and corresponding pin holes in opposing sides of the detent body to create a stationary abutment for limiting axial movement of the floating detent. A compressive spring disposed within the hollow core between the pin and the inner end urges the outer tip into the chamber. A set screw threaded into the end of the hollow core engages the pin and the floating detent. Rotation of the set screw regulates axial movement of the outer tip into and out of the chamber.

12 Claims, 6 Drawing Sheets

PAINT-BALL SPORT GUN WITH ADJUSTABLE DETENT ASSEMBLY

This application claims priority from provisional application No. 60/484,110 filed Jun. 30, 2003.

BACKGROUND OF THE INVENTION

1. Field of the Invention

The present invention relates to paint ball sport guns. More particularly, the invention relates to an adjustable ball detent assembly for constraining a paint-ball in the gun chamber prior to firing.

2. Description of the Related Art

Paint-ball sport guns are typically provided with a ball-detent mechanism for retaining a paint-ball in the gun chamber prior to firing. Such mechanisms commonly include a sphere resting on a helical spring, or a detent member comprising a body with a hemispherical section on its tip. The mechanism is secured to the side of the gun chamber, so that a ball-detent protrudes into the chamber and blocks the path of the ball from the chamber to the barrel. Because of the snug fit between the chamber/gun-barrel and the paint-ball, protrusion of a ball-detent, even a small distance into the chamber, will block the ball from rolling into the barrel prior to actuation, such as occurs when the sport gun is fired.

Because the ball-detent protrudes into the chamber most commonly by the force of a spring, if pressure is applied to the ball-detent, the spring will compress. As the spring retracts, the ball-detent collapses into the detent body, thereby allowing the paint-ball to move past the ball-detent and into the gun barrel. After the paint-ball passes the ball-detent, the spring returns the ball-detent to its extended position, again protruding into the chamber and retaining the next paint-ball within the chamber.

The distance the detent-ball must travel to retract flush with the inner surface of the chamber, affects the speed at which successive paint-ball rounds can be fired. Additionally, the mechanical process of retraction into the detent body and returning to an extended position can be felt by the gun operator. This mechanical/sensory feedback affects the shooters sense of smoothness and rhythm for discharging a paint ball. Experienced shooters develop individual preferences for the feel of this action.

The diameter and uniform roundness of paint balls is also known to exhibit slight variations between manufacturers, or even separately produced paint-ball batches by a single manufacturer. The thickness of the shell, pressure of paint inside the shell, and even the age of the paint ball can further affect the deformation of the paint ball as it passes the detent mechanism. As a result, the smoothness of operation, rhythm of the bolt action, and resistance offered by the ball-detent and the "feel" to the operator can vary from paint ball batch to paint ball batch.

Because ball-detent assemblies are typically mounted by rotation it into a threaded detent-hole, to individualize the feel of the action, paint-ball shooters sometimes unscrew the assembly a select amount to affect the distance the ball-detent extends into the chamber. However, once the ball-detent assembly is loosened, it is free to rotate, and tends to unscrew. As a result, the ball-detent gradually protrudes less and less into the chamber. At first, this affects the "feel" of the gun. As the unscrewing continues, the paint-ball can roll from the chamber to the barrel prematurely. Eventually, the loosened ball-detent can unscrew completely, falling out of the gun, and often being lost somewhere in the playing field.

There is, therefore, a need for a method and apparatus for individualizing the mechanical feedback of a shooting cycle for a particular shooter. There is further a need for a ball detent that extends into a chamber a distance consistent with the preferences of an individual shooter without loosening the engagement of the ball-detent assembly in the detent-hole. Additionally, there is a need for a detent mechanism that can be easily and reliably adjusted according to the particular parameters and variations of each batch of paint balls.

BRIEF SUMMARY OF THE INVENTION

The present invention is directed to a method and apparatus for individualizing the mechanical feedback of a shooting cycle for a particular shooter. The present invention is also directed to a ball detent that extends into a chamber a distance consistent with the preferences of an individual shooter without loosening the engagement of the ball-detent assembly in the detent-hole. Additionally, the invention provides an adjustment means to accommodate particular variations in the definable parameters of a batch of paint balls, including but not limited to diameter, uniform roundness, hardness of the shell, thickness of the shell, and pressure of the paint within the shell.

A paint-ball sport gun includes a chamber in communication with a source of paint balls. The chamber is coupled to a barrel. An advance mechanism is configured to forcibly advance a paint ball from the chamber into the barrel during actuation. As used herein, a detent-assembly comprises a detent body and a floating-detent with an outer tip.

The floating-detent is configured to reciprocate between a first position and second position. In the first position, the outer tip of the floating detent protrudes a first distance into the chamber that is sufficient to block passage of a paint ball into the gun barrel. In the second position, the outer tip does not protrude into the chamber, thereby allowing passage of the paint ball.

A securing means fixes the detent-assembly to the gun. The securing means comprises a threaded detent-hole extending through a side wall of the chamber. The detent-assembly has a body with a threaded nose configured to engage corresponding threads in the detent-hole. The first distance that the outer tip protrudes into the chamber is adjustable through an adjustment means separate from the securing means.

The detent assembly includes a resilient member, preferably a compression spring, configured to urge the floating detent toward the first position. The floating detent has a substantially cylindrical shape with a first end comprising a dome shaped outer tip. The floating detent has a hollow core with an open end and an opposing closed end defined by an inner surface. The open end provides the entrance to the hollow core. The resilient member is disposed within the hollow core. The inner surface of the open end includes a detent threaded portion. The adjustment means comprises a threaded set screw threadably engaged with the above detent threaded portion.

The floating detent may have a curved or polygonal cross-section. Preferably, it is cylindrical and symmetrical about a center axis. The floating detent has a first slot and a second slot extending through corresponding opposite detent side walls. The slots have a length that is aligned parallel to the center axis. A cross pin is oriented about perpendicular to the center axis and extends across the hollow core and through each of the first and second slots.

The resilient member is disposed within the hollow core and extends from the cross pin to the interior closed end.

The body of the detent assembly has a first pin opening and a second pin opening that extend through corresponding opposing body walls. Opposite end portions of the pin are held within respective first and second body pin openings. A pin O-ring extends around the periphery of the body and overlies the first and second pin holes to prevent the cross pin from falling out. A nose O-ring extends around a nose portion of the body and functions to frictionally secure the detent assembly to the external surfaces of the gun chamber.

A method for adjusting the distance that the floating-detent outer tip protrudes into the chamber of the paint ball gun comprises the steps of rotating the set screw, which is threadably engaged with the floating detent, axially moving the floating detent in a direction corresponding to the direction of rotation of the set screw; and decompressing or compressing the spring disposed within the hollow core of the detent cylinder in accordance with the direction of the rotation of the set screw. The set screw is adjusted without the necessity of loosening the threaded engagement between the body of the detent assembly and the gun, as is common in the prior art.

DETAILED DESCRIPTION OF THE INVENTION

Figure 1:
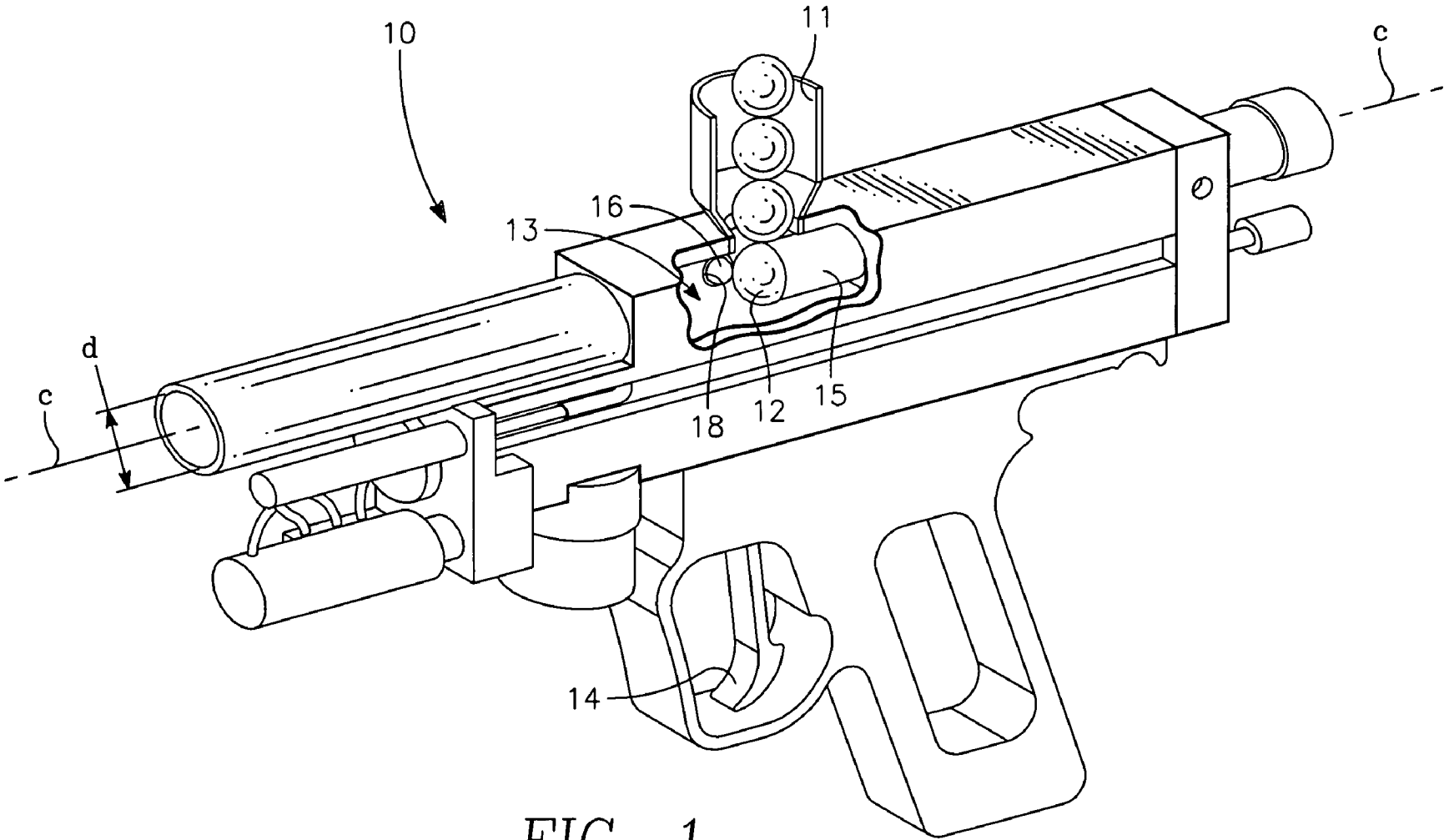
FIG. 1 is a left side isometric view of a paint-ball sport gun having a cut-out area showing the paint-ball loading chamber of the gun in communication with the detent assembly of the present invention.
Figure 2:
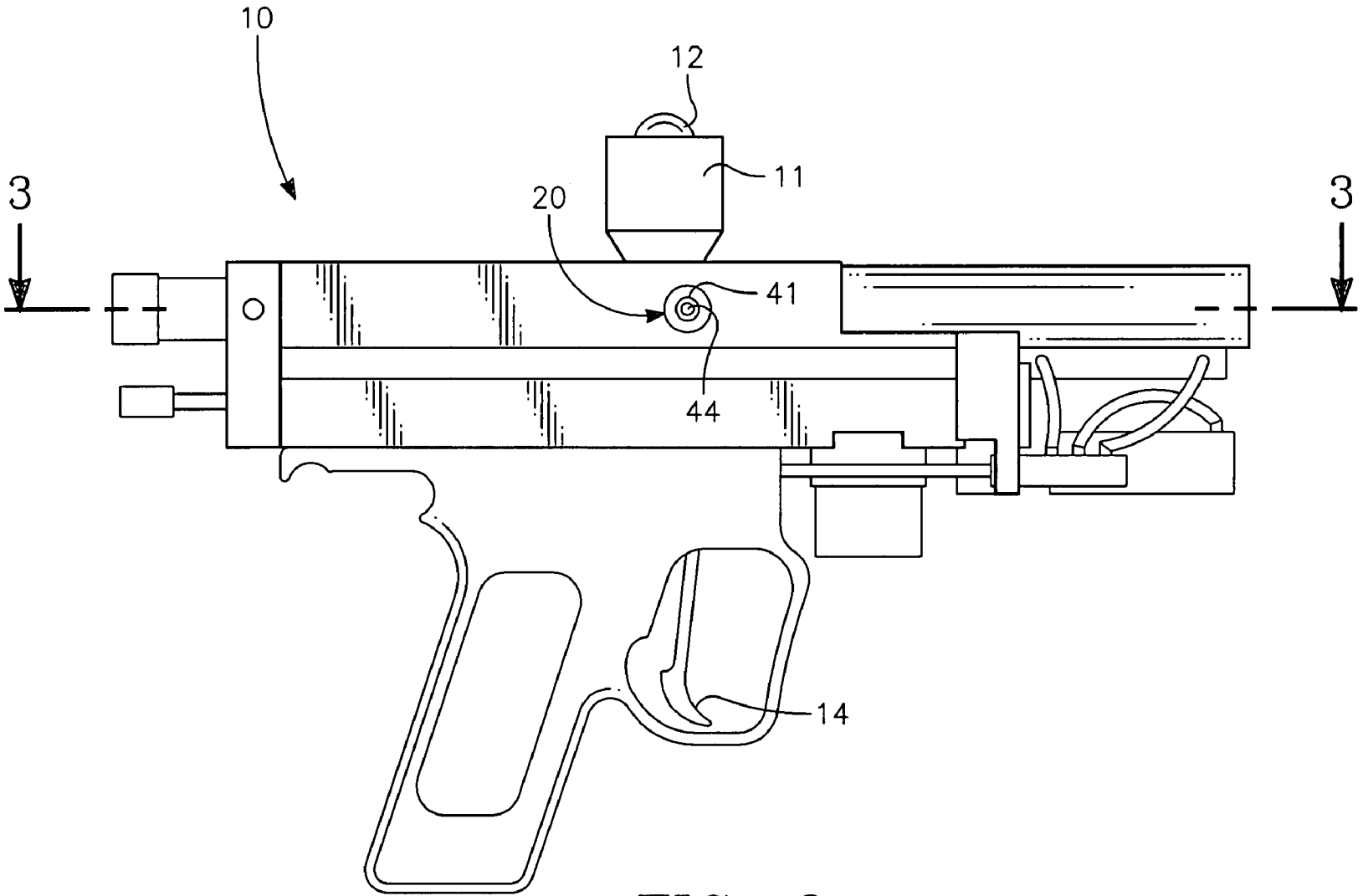
FIG. 2 is a right side elevational view of the paint-ball sport gun shown in FIG. 1.
Figure 3:
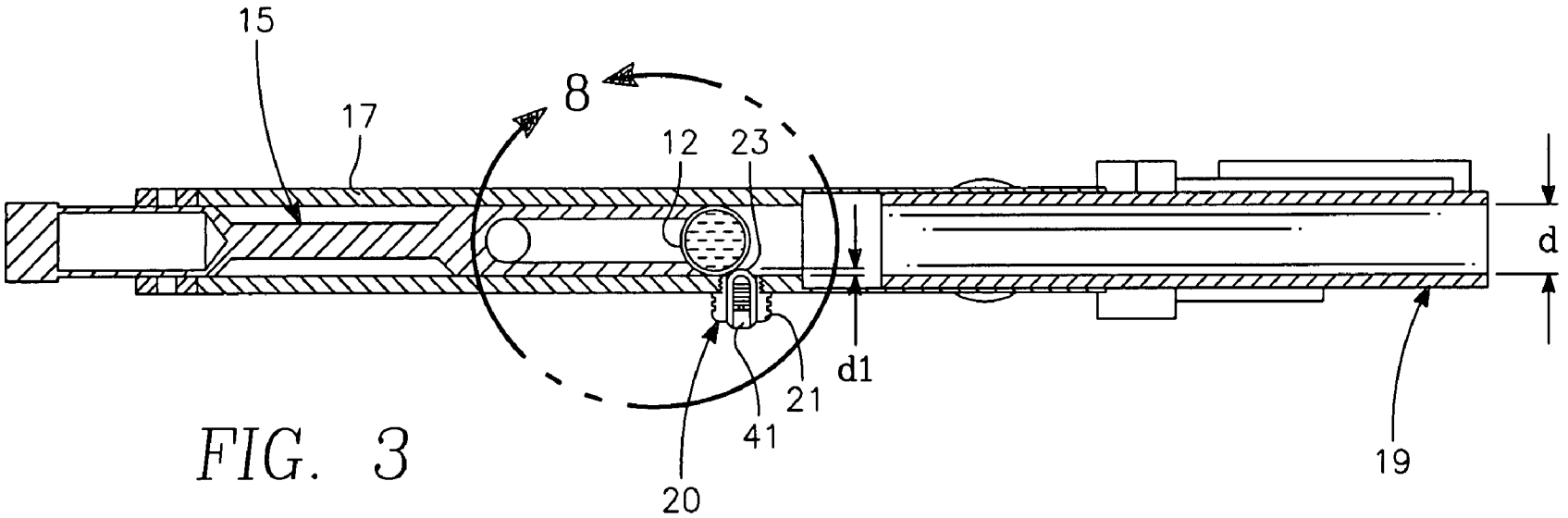
FIG. 3 is a cross sectional view taken along lines 3—3 of FIG. 2.

FIGS. 1 and 2 are different views of a paint-ball sport gun 10 illustrating various operational features of the overall gun. A magazine feed 11, in the form of a hollow cylindrical member with a funnel portion at the lower end, feeds a paint ball 12 into the loading chamber 13. The paint-ball 12 comprises a spherical breakable shell containing a dye or paint. Upon impact in competitive shooting, the spherical shell breaks open and deposits paint onto a target. The spherical shell is typically a deformable plastic that is rigid enough to substantially maintain its spherical shape in flight. The ball, however, deforms and flattens as it impacts the target. This functionality is important since paint balls are fired at people in competition. Therefore, they are engineered to inflict minimal pain, discomfort or injury to a person impacted by the paint-ball 12.

To actuate the discharge of the paint-ball 12, a user pulls a gun trigger 14. Bolt 15 of the gun then slides forward along the gun axis c,c, pushing the ball into the gun barrel 19. The bolt 15 is typically a hollow cylindrical member with an outer diameter slightly smaller than the diameter of the paint ball 12. The end of the bolt 15 that contacts the paint-ball 12 is concave with a radius of curvature that corresponds to the shape of the paint-ball outer shell. This matching configuration facilitates maximum contact area between the bolt 15 and the paint-ball 12, more evenly distributing the force of the bolt against the paint-ball as the bolt 15 advances. After the ball 12 is fed from the magazine feed 11 into the chamber 13, it must remain in the chamber 13 until actuation.

Once the paint-ball 12 is in the gun barrel 19, compressed air or carbon dioxide accelerates the paint-ball out the end of the barrel toward a target. To facilitate a minimum of air leakage, the inner diameter "d" of the barrel 19 is about identical to the outer diameter of the paint-ball 12.

A floating detent 16 reciprocates within a detent body 21. The detent body is threadably secured within a detent hole 18 formed through the side wall 17 of the chamber 13. When the outer tip 23 of the floating detent 16 projects into the chamber 13, it prevents the paint-ball from inadvertently rolling out of the chamber 13 and into the barrel 19.

Figure 8:
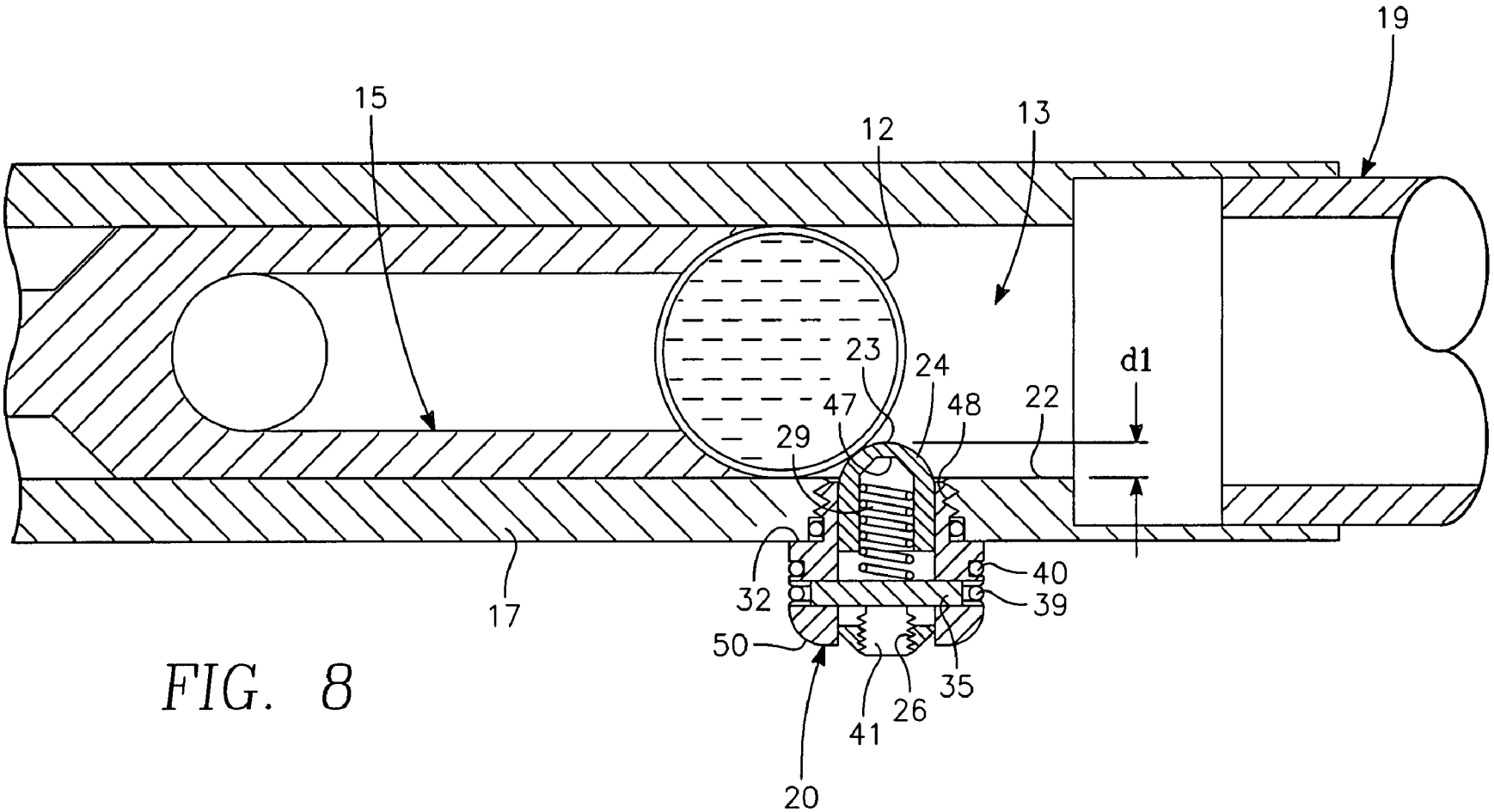
FIG. 8 is an enlarged fragmentary view taken along lines 8—8 of FIG. 3.

As best illustrated in FIG. 8, the floating detent tip 16 is urged into the chamber 13 by a resilient member, such as helical compression spring 29. The outer tip 23 of the floating detent is dome-shaped and provides a rounded outer surface. Therefore, when the bolt 15 forcibly advances the paint-ball 12, the paint-ball slides across the domed surface, dividing the force imparted to the paint ball into a linear aspect in line with the direction of travel of the bolt 15, and a perpendicular aspect in line with the direction of travel of the floating detent 16. This action thereby causes the floating detent to retract and permit passage of the paint ball into barrel 19.

According to a preferred configuration, the rounded surface of outer tip 23 comprises a smooth, rigid hemispherical segment. However, other curved or angular inclined shapes are envisioned within the scope of the present invention.

According to the preferred embodiment, when the floating detent 16 is pushed backward by the paint ball, the direction of travel of the floating detent is not more than about ninety degrees from the direction of travel of the bolt. Although angles more than ninety degrees are envisioned within the scope of the present invention, excessive force and friction may be required to depress the floating detent, which could cause the paint-ball to rupture. Accordingly, such excessive angles are not preferred. For tooling purposes, it is usually easiest to drill a hole through the side wall 17 of chamber 13 at right angles to the direction of travel of the bolt 15.

The detent-assembly 20 includes a detent body 21 threadably secured to the wall 17 of the chamber through a threaded detent hole 18 in the chamber wall 17. A center bore 33 extends coaxially through detent body 21 along longitudinal axis a,a. The center bore has a diameter d2, which is slightly greater than the outside diameter of the detent part 24. Therefore, the floating detent 16 can be inserted into the center bore 33 and freely reciprocate therein as described above.

The detent body 21 further includes a first pin opening 34 and a second pin opening 35 for a purpose to be hereinafter described. The pin openings preferably have identical shapes and extend through opposing walls of the detent body.

The outer tip 23 of floating detent 16, when in an unextended state, projects into the chamber 13 by a distance d1. When the floating detent 16 is depressed by the paint-ball 12, the outer tip 23 will be substantially flush with the interior wall 22 of the chamber 13.

As discussed above, the detent assembly is adjustable such that the distance d1, which the outer tip 23 of the floating detent 16 protrudes into the chamber 13, can be adjusted to the desired "feel" of an individual shooter. This assembly can further be re-adjusted at any time to compensate for variations in the various parameters of a paint ball that can affect the smoothness of operation, rhythm, speed or feel of the chambering of a paint ball during actuation.

As best seen in FIGS. 4–8, the floating detent 16 comprises a detent part 24 with an outer tip 23 at an outer end portion. The detent part may have a curved or polygonal cross-section. In the preferred embodiment shown, it has a cylindrical shape and the outer tip comprises a spherical section.

The opposing inner end portion of the detent part 24 has an open end portion 27 extending into a hollow core 46, which terminates at closed end portion 47. The inner surfaces of the open end portion 27 are provided with inner threads 26 for engaging corresponding set screw threads 43 as described below. An elongated first slot 25 extends through a first wall portion of the detent part 24, and an elongated second slot 28 (shown in phantom) extends through an opposing second wall portion of the detent part. The slots are preferably located proximate open end portion 27, and are directly opposite each other. They have about identical shapes, and are oriented parallel to the center axis a,a (FIG. 4) of the detent assembly 20.

The first and second slots 25, 28 have a width that is sufficient to allow a cross pin 45 to extend through both slots. As the floating detent 16 reciprocates, it is guided both by the center bore 33 of the detent body 21, and by the cross pin 45 extending through the slots. The floating detent 16 can reciprocate back and forth in center bore 33 with the maximum axial movement defined by the length of the first and second slots.

The pin 45 is preferably a solid shaft having a length sufficient to span hollow core 46 and extend into the aforementioned first pin opening 34 and second pin opening 35. Preferably, the pin openings are located within a first groove 36 of the detent body 21, within which is fitted a pin O-ring 39. The pin length will correspond to the diameter of the first groove. In this way, when the floating detent 16 is slidably engaged within center bore 33 of the detent body, opposing ends of the cross pin 45 will transit through opposing walls of both the detent part 24 and the detent body 21. Subsequent placement of the pin O-ring in first groove 36 will constrain the pin in its operative position.

Within detent part hollow core 46, is a resilient member shown as compression spring 29. The spring has an outer diameter that is less than the hollow core 46 diameter so that the spring 29 can fit into the core. The spring should have sufficient length to be slightly compressed between pin 45 and closed end 47. In this way, the floating detent will always be biased toward an outermost first position. Examples of alternative resilient members are elastic plugs, flex strips, pneumatic mechanisms, piston assemblies and washer springs.

The detent body 21 comprises an outer body portion 50 that extends to a threaded nose portion 30. The body may be formed from a solid material, such as metal, plastic or a curable cast resin that may be molded or tooled. The nose portion 30 includes exterior nose threads 31 that threadably engage the corresponding chamber wall threads 48 within detent hole 18. A shoulder 32 is formed at the juncture of the outer body portion 50 and the nose portion 30.

Although optional, the outer body portion 50 is shown with a second groove 37. The second groove is located adjacent the first groove 36 to provide a receptacle for a spare O-ring 40.

A nose O-ring 38 is sized to compress against the shoulder 32 while disposed snugly around the periphery of the nose 30. This O-ring functions to inhibit loosening of the detent body from its threaded engagement with detent hole 18. The nose O-ring also provides a sealing engagement with the outer chamber wall 17 that surrounds detent hole 18. The pin and spare O-rings 39, 40 are identically sized to respectively fit securely within either one of the first groove 36 and second groove 37.

Figure 4:
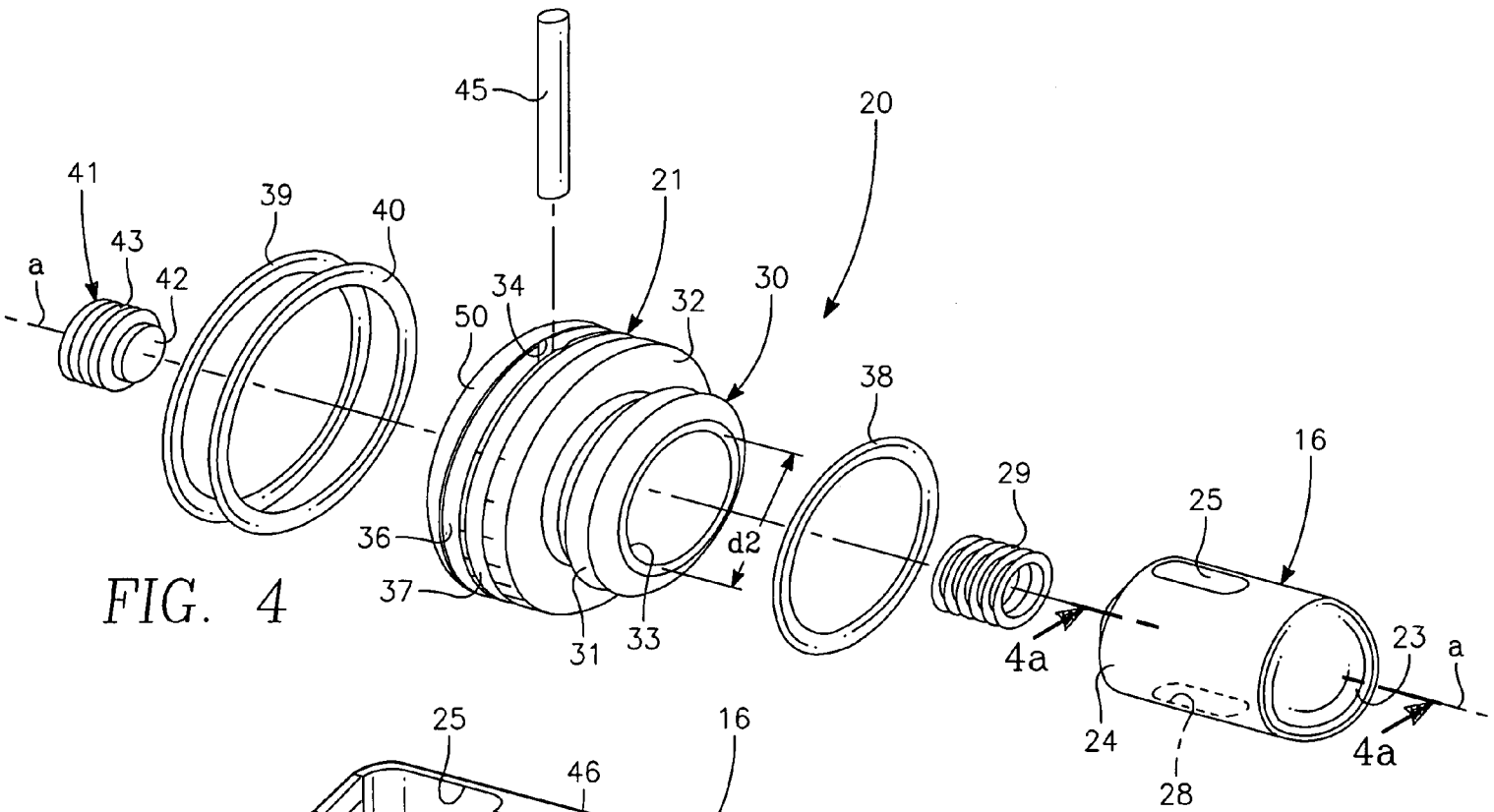
FIG. 4 is a front isometric exploded view of the detent assembly shown in FIG. 3.
Figure 4A:
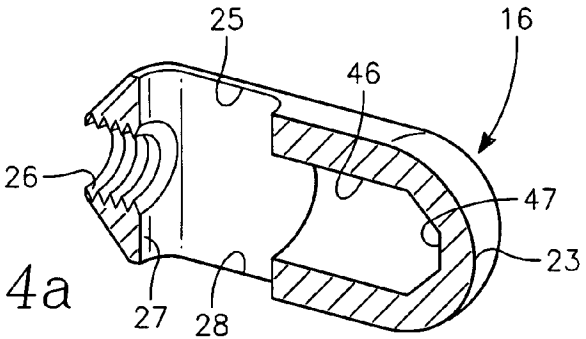
Figure 5:
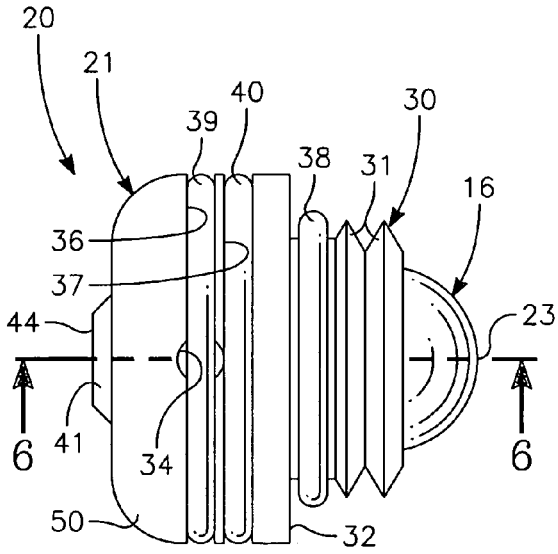
FIG. 5 is a enlarged top plan view of the detent assembly shown in FIG. 3.
Figure 6:
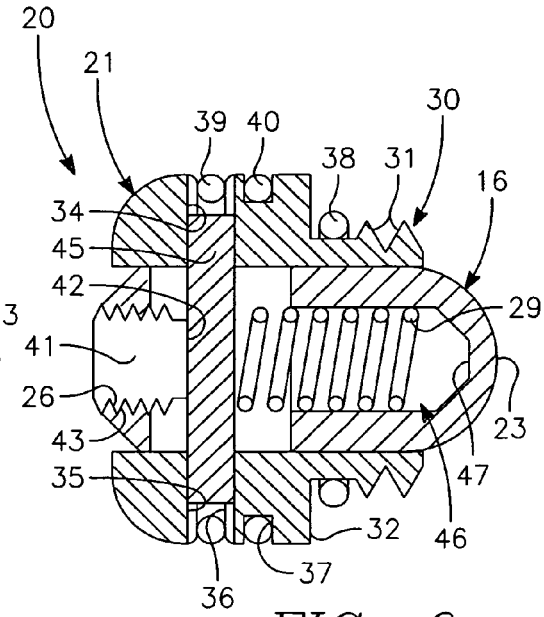
FIG. 6 is a cross sectional view taken along lines 6—6 of FIG. 5.
Figure 7:
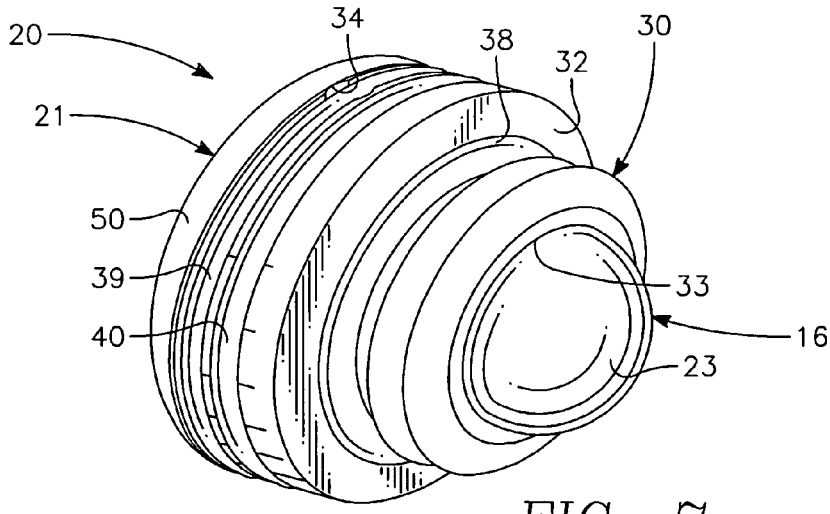
FIG. 7 is a front isometric view of the detent assembly shown in FIG. 5.

As best shown in FIG. 4, a set screw 41 is provided having set screw threads 43 configured to engage inner threads 26 in the open end portion 22 of detent part 24. Inner face 42 of the set screw abuts against pin 45. The outer end 44 of the set screw has a tool engagement means, known in the art, for engaging a tool. The engagement means may comprise a blade slot, projection, Phillips recess or socket opening which is shaped to accommodate a tool such as an Allen wrench, socket wrench or screwdriver.

With the above arrangement, it can be seen that rotation of the set screw with a tool while inner end 42 is abutted against pin 45, will translate the screw pitch into axial movement of the floating detent 16. The extent of axial movement per revolution of the set screw will be dictated by the pitch of the inner threads 26 of the detent cylinder and corresponding set screw threads 43. The set screw 41 will preferably be a selflocking set screw, having a locking part such as an elastic collar, plastic insert or a locking nut member known in the art.

Assembly

Referring primarily to FIG. 4, compression spring 29 is inserted into the hollow core 46 of the detent part 24 through the open end portion 27. The detent part is then moved into the center bore 33 of the of the detent body 21 such that the outer tip 23 of the floating detent 16 is oriented toward nose 30. The detent part may now be rotated so that the first and second slots 25, 28 are aligned with respective first and second pin openings 34, 35.

After achieving the above orientation, pin 45 is moved through the aligned pin openings and slots. During movement of the pin 45 through the hollow core 46 of the detent part 24, spring 29 must be pressed "forward" (toward the outer tip 23) with a narrow tool such as a nail or screw driver, so that the pin can pass freely behind the spring. When assembly has been completed properly to this point, the spring 29 will be compressed between the pin and the inner end of hollow core 46.

The pin O-ring is now placed around the first groove 36 to prevent the pin from becoming dislodged from the slots and pin openings. The optional spare O-ring 40 may be secured in the second groove 37. In this way, the spare O-ring will be conveniently available to replace the pin O-ring.

The nose O-ring is slipped over nose 30 and around shoulder 32. The detent body 21 is then gripped by the fingers, and the nose threads 31 are rotatably engaged with corresponding chamber wall opening threads 48. Rotation of the detent assembly into opening 18 is continued until the outer surface of the gun chamber wall 17 compresses the nose O-ring 38 and sealingly secures the detent assembly 20 to the gun. The set screw 41 is then rotated into engagement with inner threads 26 of the detent part 24 until inner face 42 engages the transversely extending pin 45.

Operation

Because pin 45 is mounted in first and second pin openings 34, 35 in the detent body 21 of the assembly, and the detent body 21 is threadably secured to the gun chamber wall 17, the pin 45 cannot move relative to the gun 10. More specifically, when the inner face 42 of set screw 41 is rotated against the pin 45, it cannot push the pin forward. Consequently, the force is translated to an axial motion, wherein the inner threads 26 of the floating detent will move the floating detent forward or backward, depending on the direction of rotation. Consequently, the distance d1 that the outer tip 23 extends into the chamber 13, can be conveniently increased or decreased. A user can visually observe the distance which the outer tip 23 is protruding into the chamber 13 while simultaneously rotating the set screw 41. Rotation can continue until the desired protrusion distance d1 is achieved.

One method used by shooters to adjust the protrusion distance d1 is to visually observe the relationship of the detent to a paint-ball in the chamber. Variations in paint-ball diameter or roundness of paint balls may be visually apparent to some shooters. Alternatively, or in conjunction with visual adjustment, a user can discharge a paint-ball round and note the feel of the advance mechanism during chambering. According to the feel of the discharge of the round, the user will determine if the distance d1 that the outer tip 23 protrudes into the chamber 13 should be increased, decreased, or remain as it is. The user can continue to re-adjust the set screw 45 and re-fire the gun until the feel is according to the user's preference.

A particular advantage of the claimed invention relates to the fact that the adjustment of the set screw takes place while the detent assembly 20 is secured to the gun chamber. Accordingly, the detent assembly 20 does not have to be loosened from the gun 10 to adjust the depth d1.

Those skilled in the art will also recognize that the compressed nose O-ring 38 acts like a lock washer by maintaining a linear force on the threads, and thereby reduces the ability of the detent assembly 20 to unscrew. In a similar manner, spring 29 has a selected length and compression strength to maintain a continual outward pressure from the pin 45 to the outer tip 23 to maintain an outward bias on the outer tip. However, the outward bias should not exceed the rupture point of the paint-ball shell.

Within the foregoing description, many specific details commonly understood by those skilled in the art have not been recited so as to not needlessly obscure many of the essential features of the present invention. In other instances, some non-essential details of the present invention have been recited in the detailed description to better enable the reader to make and use the claimed invention. The many details within the foregoing description are, therefore, not intended to limit the scope of the claims appended hereto, said claims being intended to cover alternative structures, processes, modifications, and equivalents which may be included within the spirit and scope of the foregoing description and the appended claims.

I claim:

1. A paint-ball sport gun comprising:

a) a receiver having a chamber coupled to a barrel;

b) an advance mechanism attached to the gun for forcibly advancing a paint ball from the chamber into the barrel;

c) a detent-assembly comprising a floating-detent with an outer tip;

d) an adjustment means for moving the floating-detent between a first position and second position, wherein in said first position, said outer tip protrudes a first distance into said chamber, and wherein, in said second position, said outer tip does not protrude into said chamber, whereby, when said chamber contains a paint-ball, said outer tip in said first position restricts passage of said paint ball from said chamber into said barrel, and in said second position, said outer tip does not restrict passage of said paint-ball from said chamber to said barrel, said detent assembly further comprising a compression spring configured to urge said outer tip toward said first position, said floating detent having a substantially cylindrical shape and a hollow core with an open end, said compression spring being disposed within said hollow core; and, e) a securing means for fixing said detent-assembly to said chamber.

2. The paint-ball sport gun according to claim 1, said chamber having a wall, wherein said securing means comprises a threaded detent-hole extending through said wall, said detent-assembly comprising a detent body with a threaded nose configured to engage said threaded detent-hole.

3. The paint-ball sport gun according to claim 1 wherein said open end includes inner threads, the adjustment means comprising a set screw threadably joined to said inner threads.

4. The paint-ball sport gun according to claim 3 wherein said floating detent has a longitudinal axis and further comprises a first slot and a second slot extending through opposite sides of said floating detent, said slots being aligned about parallel to said longitudinal axis.

5. The paint-ball sport gun according to claim 4 further comprising a pin extending through said first slot and said second slot, said compression spring being disposed within said hollow core between said pin and said outer tip.

6. The paint-ball sport gun according to claim 5 wherein said detent-assembly includes a detent body having a first pin opening and an opposing second pin opening, said pin extending across said hollow core and simultaneously through said first slot and said first pin opening and said second slot and said second pin opening.

7. The paint-ball sport gun according to claim 6 further comprising a pin O-ring extending around said detent body and overlying said first pin opening and said second pin opening.

8. The paint-ball sport gun according to claim 7 wherein said chamber has an external wall surface, said detent body further comprising a nose O-ring disposed on said threaded nose of said body and compressed between said detent body and said external wall surface.

9. In a paint-ball sport gun having a chamber defined by opposing walls for paint-balls wherein the improvement is a paint-ball detent assembly comprising:

a detent body secured to one of said opposing walls, said detent body having a center bore with a center axis and opposing coextensive pin openings extending through said detent body about perpendicular to said center axis;

a floating detent positioned for reciprocation in said center bore, said floating detent comprising:

a) a detent part with an outer tip and a hollow core that extends from a closed end to an open end;

b) opposing coextensive slots extending through said detent part;

c) a pin extending through said pin openings and said slots across said hollow core; and, d) a resilient member fitted in said hollow core between said pin and said closed end to bias the outer tip outwardly into said chamber.

10. The sport gun of claim 9 including an adjustment means connected to said open end for moving the floating detent axially in said center bore.

11. The sport gun of claim 10 wherein said open end includes inner threads and said adjustment means comprises a set screw engaged with said inner threads, said set screw having an inner face that abuts against said pin.

12. The sport gun of claim 11 wherein said slots have a predetermined length that is coextensive with said longitudinal axis, said length defining the maximum axial movement of said floating detent.

* * * * *